United States Patent [19]

Mishiumi et al.

[11] 3,960,326

[45] June 1, 1976

[54] APPARATUS FOR PAINT APPLICATION

[75] Inventors: Yoshio Mishiumi, Tokyo; Yukio Nagasaka, Kawagoe, both of Japan

[73] Assignee: Atom Chemical Paint Co., Ltd., Tokyo, Japan

[22] Filed: Jan. 6, 1975

[21] Appl. No.: 538,966

[30] Foreign Application Priority Data

Sept. 5, 1974 Japan ..... 49-106090

[52] U.S. Cl. ..... 239/214; 118/DIG. 16

[51] Int. Cl.[2] ..... B05B 3/02

[58] Field of Search ..... 118/DIG. 16; 239/214, 239/222, 219; 222/414, 410; 239/220

[56] References Cited

UNITED STATES PATENTS

| | | | |
|---|---|---|---|
| 2,352,749 | 7/1944 | Wills | 239/222 X |
| 2,368,742 | 2/1945 | Brend | 118/DIG. 16 |
| 2,876,039 | 3/1959 | Vogdt | 425/305 X |

FOREIGN PATENTS OR APPLICATIONS

| | | | |
|---|---|---|---|
| 842,730 | 7/1960 | United Kingdom | 239/222 |

*Primary Examiner*—John P. McIntosh
*Attorney, Agent, or Firm*—Woodhams, Blanchard and Flynn

[57] ABSTRACT

An apparatus for applying a paint on a road which comprises a paint supply means provided with a plurality of orifices in two rows in an opposite relation on a lower portion of said paint supply means for discharging paint, a tank provided on the top of said paint supply means for containing a paint, a pair of wire roll brushes attached to said paint supply means to rotate inwardly and disposed adjacent said orifices, and a pair of roll brush-cover members each having a sharp edge at the other end which is disposed in a position to touch the lower side of said wire roll brushes.

With such paint supplying apparatus, the paint is prevented from scattering in an undesirable direction and consequently there can be drawn or produced lines which have a fixed width and thickness of paint on the road surface without regard to the rise and fall of the road surface.

5 Claims, 4 Drawing Figures

APPARATUS FOR PAINT APPLICATION

This invention relates to an apparatus for paint application which is used to draw center lines and other signs on road surfaces for traffic control.

Number of devices have been proposed for drawing the center lines and other signs on road surfaces. However, none of these devices satisfy requirements such as, 1) a capability of drawing lines having fixed width and thickness of paint all through the lines 2) a reliability of paint adhesion to the road surfaces 3) simplicity in the structure of the device. In addition, with the conventional devices, it is difficult to apply a high viscosity paint onto a road. For example, the paint lines produced using a conventional air spray type device are of such disadvantageous cross-sections as shown in FIGS. 1 and 2.

In FIG. 1, the line has a portion *a* in which the paint is more thickly accumulated than in the other portions of the line and one or more unfavorable portions *b*. In FIG. 2, the line also has a portion *a* in which the paint is more thickly accumulated at the other portions and portions *c* in which the paint is thinly applied so that the edges of the lines are not clear. It is therefore difficult to obtain a clear, uniform line on the road.

The present invention has been made to overcome the above mentioned defects.

Accordingly, an object of the present invention is to provide an apparatus for paint application including a pair of wire roll brushes and a pair of cover members each of which is connected at one end to an external portion of a paint supply means in such manner as to cover each of the wire roll members and has a sharp edge at the other end, whereby the paint is prevented from scattering in an undesired direction and consequently there can be drawn or produced lines which have a fixed width and thickness of paint on the road surfaces without regard to the rise and fall of the road surfaces.

According to the present invention, there is provided an apparatus for paint application comprising a paint supply means incorporating therein a valve means and provided with a plurality of orifices in two rows in an opposite relation on a lower portion of said paint supply means for discharging paint, a tank communicating said paint supply means for containing a paint, a pair of wire roll brushes attached to said paint supply means to rotate inwardly and touch said orifices, and a pair of cover members each of which is connected at its one end to said paint supply means to cover each of said wire roll brushes and has a sharp edge at the other end which is disposed in a position to touch the lower side of said wire roll brushes.

This invention will be more particularly described with reference to the accompanying drawing in which.

Figure 3:
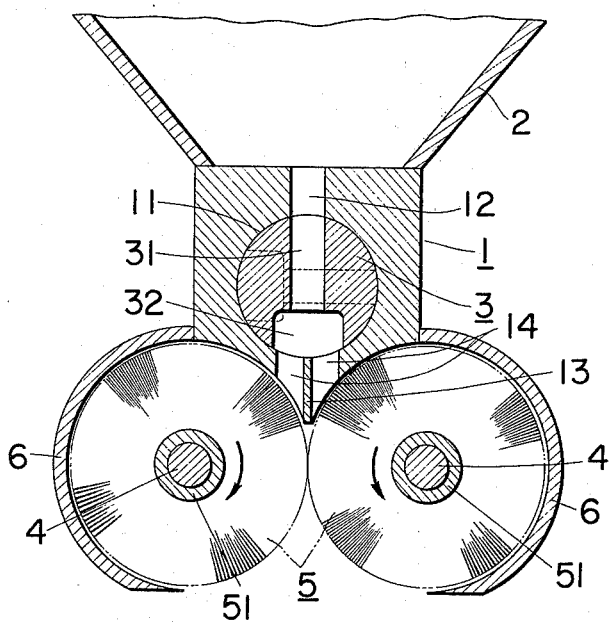
FIG. 3 is a vertical sectional view of an apparatus according to the present invention.
Figure 1:
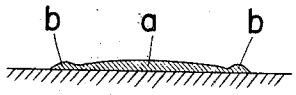
FIG. 1 is a vertical sectional view of a line drawn by a conventional apparatus.
Figure 2:
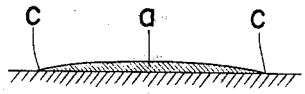
FIG. 2 is a vertical sectional view of another line drawn by a conventional apparatus.
Figure 4:
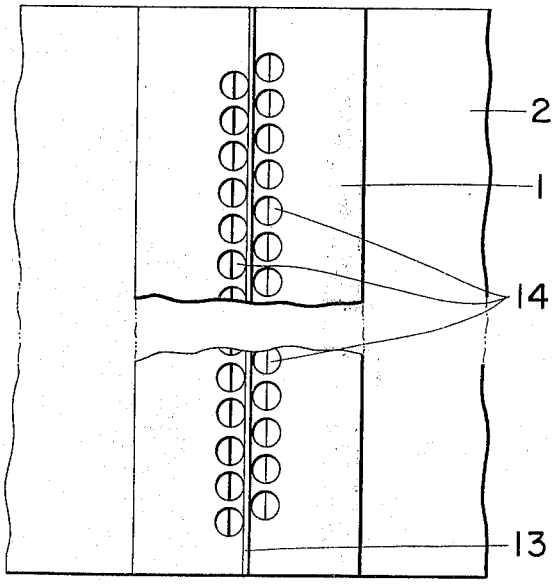
FIG. 4 is a bottom view of the paint supply means of the apparatus shown in FIG. 3.

Referring now to FIGS. 3 and 4, numeral 1 indicates a paint supply means carrying a paint tank 2 on the top thereof. Numeral 3 indicates a roll-shaped rotation valve means which is rotatably fitted in a bore-like space 11 which is formed longitudinally in the body of the supply means 1. Above said space 11 of the paint supply means 1, there is provided a passage 12 which communicates with the paint tank 2. On the both sides of the longitudinal central portion 13 of the bottom of the paint supply means 1, there are formed a plurality of orifices for paint discharge which are provided in two rows. The rotation valve means 3 is provided with an upper passage 31 and a lower passage 32 having a comparatively enlarged width and communicating with said passage 31. In operation, the rotation valve means 3 cooperates with said passage 12 and a plurality of bores 14 communicating with the respective orifices to form passages for paint.

Numeral 4 indicates a pair of rotating shafts mounted at the lower portion of the paint supply means 1 and adapted to be rotated in a the directions shown by arrows in FIG. 3 at a velocity as high as, for example, more than 5,000 r.p.m. by a motor (not shown) through an appropriate interlocking mechanism (not shown). Numeral 5 indicates a pair of wire roll brushes each of which is formed on a hollow shaft 51. The hollow shaft 51 is fixedly connected to the rotation shaft 4 as shown in FIG. 3. Numeral 6 indicates a pair of cover members each of which is at its one end provided with a sharp edge. The tip end of the sharp edge is disposed in a position almost touching the lower portion of the wire roll brush 5. Each of the cover members 6 is secured to the external lower portion of the paint supply means 1 so as to cover the wire roll brush 5 as depicted in FIG. 3.

With the arrangement mentioned above, the paint in the paint tank 2 is discharged from the orifices passing through the passage 12 of the paint supply means 1 and the passages 31 and 32 of the rotation valve means 3. The paint is then supplied to the wire roll brushes 5 and finally, the paint is discharged from the portion in which the wire roll brushes oppose each other. On this occasion, a part of the paint sticks to the wire roll brushes and travels to the inner side of the cover members 6 so that it is discharged from the portion in which the wire roll brushes oppose each other. With the provision of such wire brushes, the paint is not discharged excessively but discharged only in sufficient quantity to draw clearly uniform lines.

It is to be noted that the present invention should not be limited to the embodiment as described above. For example, the orifices communicating with passages 14 may alternatively be provided on an appropriate lower portion of the paint supply means 1 (not the bottom portion) as far as the orifices are touched by the roll wire brushes.

What is claimed is:

1. An apparatus for applying paint, comprising:

a tank for holding paint;

an elongated paint supply means having inlet passage means at its upper end for receiving paint from said tank, two elongated parallel rows of longitudinally spaced-apart discharge orifices at the lower end of said paint supply means for discharging paint therefrom, said rows being transversely spaced from each other and extending in the longitudinal direction of said paint supply means, and a movable valve located between said inlet passage means and said rows of discharge orifices for controlling flow of paint from said inlet passage means to said discharge orifices;

a pair of parallel, elongated, rotatable, cylindrical, wire brushes disposed directly below and whose axes of rotation extend longitudinally of said paint supply means and said rows of discharge orifices, said brushes being disposed in radially opposed, adjacent relationship and being adapted to be rotated in opposite circumferential directions, the downwardly moving peripheral portions of the brushes being disposed in confronting relationship and defining a nip between the brushes, said rows of orifices being disposed above said nip and in closely spaced relation to the brushes so that the brushes move circumferentially downwardly and across the orifices whereby paint can be supplied from the orifices to the downwardly moving peripheral portions of the brushes as they are about to enter the nip and thence applied to a surface disposed below said nip;

and a pair of arcuate cover members extending downwardly from said paint supply means and respectively covering the mutually remote, upwardly movable peripheral portions of the brushes, each of said cover members having a sharp edge at the inner lower end thereof, said edge being disposed directly under the lowermost point on its associated brush and in substantially touching relationship therewith to remove paint that sticks to the periphery of its associated wire brush.

2. An apparatus as claimed in claim 1 in which said paint supply means has an elongated longitudinally extending partition wall member disposed directly above the nip and extending vertically upwardly therefrom, said rows of orifices being disposed on opposite sides of said partition wall member.

3. An apparatus as claimed in claim 2 in which the orifices of one of said rows are longitudinally offset from the orifices of the other row so that the orifices of each row are positioned between two orifices of the other row.

4. An apparatus as claimed in claim 1, in which the tank has an elongated discharge opening at its lower end, said paint supply means comprises a casing attached to the lower end of said tank so that its inlet passage means communicates with the discharge opening of the tank and receives paint therefrom, said valve being movable between a first position in which said inlet passage means is out of communication with said paint discharge orifices and a second position in which said inlet passage means communicates with said paint discharge orifices.

5. An apparatus as claimed in claim 4 in which said valve comprises a rotatable valve having an upper valve passage adapted to communicate with said inlet passage means in said paint supply means and a lower valve passage of larger width than said upper valve passage and adapted to communicate with said rows of orifices.

* * * * *